US011499793B2

(12) United States Patent
McPherson

(10) Patent No.: US 11,499,793 B2
(45) Date of Patent: Nov. 15, 2022

(54) ARCHERY BOW LIMB CUP WITH DAMPER

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/342,349

(22) Filed: Jun. 8, 2021

(65) Prior Publication Data

US 2021/0293507 A1 Sep. 23, 2021

Related U.S. Application Data

(63) Continuation of application No. 16/374,599, filed on Apr. 3, 2019, now Pat. No. 11,029,121.

(60) Provisional application No. 62/652,246, filed on Apr. 3, 2018.

(51) Int. Cl.

| | |
|---|---|
| ***F41B 5/20*** | (2006.01) |
| ***F41B 5/14*** | (2006.01) |
| ***F41B 5/10*** | (2006.01) |

(52) U.S. Cl.

CPC ..... *F41B 5/1426* (2013.01); *F41B 5/10* (2013.01)

(58) Field of Classification Search

CPC ..... F41B 5/10; F41B 5/14; F41B 5/1426
USPC ..... 124/23.1, 86, 88, 89, 25.6
See application file for complete search history.

(56) References Cited

U.S. PATENT DOCUMENTS

| | | | |
|---|---|---|---|
| 3,342,172 | A | 9/1967 | Sanders |
| 3,416,508 | A | 12/1968 | Thompson |
| 3,670,712 | A | 6/1972 | Izuta |
| 3,841,295 | A | 10/1974 | Hunter |
| 3,854,467 | A | 12/1974 | Hofmeister |
| 3,958,551 | A | 5/1976 | Ketchum |
| 3,993,039 | A | 11/1976 | Groves et al. |
| 4,372,285 | A | 2/1983 | Simonds et al. |
| 4,401,097 | A | 8/1983 | Simonds et al. |
| 4,438,753 | A | 3/1984 | Simonds |
| 4,440,142 | A | 4/1984 | Simonds |
| 4,458,657 | A | 7/1984 | Stockmar |
| 4,461,267 | A | 7/1984 | Simonds et al. |
| 4,478,203 | A | 10/1984 | Hayes |
| 4,512,326 | A | 4/1985 | Jarrett |
| 4,660,536 | A | 4/1987 | McPherson |
| 4,827,894 | A | 5/1989 | Schallberger |
| 4,838,236 | A | 6/1989 | Kudlacek |
| 4,893,606 | A | 1/1990 | Sisko |
| 4,909,231 | A | 3/1990 | Larson |
| 4,993,399 | A | 2/1991 | Chattin |
| 5,005,554 | A | 4/1991 | Shepley et al. |
| 5,016,602 | A | 5/1991 | Mizek |
| 5,040,520 | A | 8/1991 | Nurney |
| D331,614 | S | 12/1992 | Martin et al. |
| 5,174,268 | A | 12/1992 | Martin et al. |
| 5,307,787 | A | 5/1994 | LaBorde et al. |

(Continued)

*Primary Examiner* — Alexander R Niconovich
(74) *Attorney, Agent, or Firm* — Laabs Intellectual Property

(57) ABSTRACT

In some embodiments, a limb cup comprises a body and a vibration damper. The body comprises a first limb cavity and a damper housing. The damper housing comprises an aperture. The vibration damper comprises a resilient member and a weight. The first limb cavity is arranged to receive an archery bow limb. The resilient member is oriented in the aperture and supported by the damper housing. The weight is supported by the resilient member.

16 Claims, 11 Drawing Sheets

(56) References Cited

U.S. PATENT DOCUMENTS 5,339,793 A 8/1994 Findley
5,362,046 A 11/1994 Sims
5,368,006 A 11/1994 McPherson
5,370,104 A 12/1994 Neie
5,411,009 A 5/1995 Thompson et al.
5,495,843 A 3/1996 Larson
5,505,185 A 4/1996 Miller
5,515,836 A 5/1996 Martin et al.
5,595,168 A 1/1997 Martin
5,638,804 A 6/1997 Remick et al.
5,678,529 A 10/1997 Larson
5,735,257 A 4/1998 Walk
5,762,060 A 6/1998 Larson
5,782,229 A 7/1998 Evans et al.
5,803,070 A 9/1998 Martin
5,809,982 A 9/1998 McPherson
5,934,265 A 8/1999 Darlington
5,934,266 A 8/1999 Martin
5,937,843 A 8/1999 Troncoso
6,105,564 A 8/2000 Suppan
6,257,220 B1 * 7/2001 McPherson ..... F41B 5/1426 124/23.1
6,360,734 B1 * 3/2002 Andrews ..... F41B 5/0026 124/23.1
6,382,201 B1 * 5/2002 McPherson ..... F41B 5/0005 124/23.1
6,526,957 B1 * 3/2003 Leven ..... F41B 5/1426 124/89
6,543,432 B2 * 4/2003 Andrews ..... F41B 5/105 124/23.1
6,550,467 B2 4/2003 Gallops, Jr.
6,588,414 B2 7/2003 McMillan, III
6,712,059 B2 * 3/2004 Donovan ..... F41B 5/1426 188/378
6,718,963 B1 * 4/2004 Wheeler ..... F41B 5/10 124/900
6,786,214 B2 * 9/2004 Andrews ..... F41B 5/10 124/23.1
7,025,051 B1 * 4/2006 Gallops, Jr. ..... F41B 5/10 124/23.1
7,264,098 B2 9/2007 McPherson
7,308,890 B1 * 12/2007 Wheeler ..... F41B 5/105 124/23.1
7,334,575 B2 * 2/2008 McPherson ..... F41B 5/0026 124/23.1
7,584,750 B2 * 9/2009 Chang ..... F41B 5/12 124/25
7,703,449 B2 * 4/2010 Wright ..... F41B 5/1426 124/89
7,954,481 B2 6/2011 Barnard
7,987,954 B2 * 8/2011 McPherson ..... F16F 7/108 267/136
8,047,189 B2 * 11/2011 McPherson ..... F41B 5/10 124/23.1
8,069,847 B2 * 12/2011 Blosser ..... F41B 5/10 124/88
8,448,633 B2 5/2013 McPherson
8,453,635 B1 * 6/2013 McPherson ..... F41B 5/1403 124/25
8,839,775 B2 * 9/2014 Wasilewski ..... F41B 5/1426 124/89
8,931,470 B1 * 1/2015 Khoshnood ..... F41B 5/1426 124/89
8,939,139 B2 1/2015 Sims
9,032,947 B2 5/2015 Bidgare
9,038,617 B1 5/2015 Khoshnood
9,046,317 B2 6/2015 McPherson
9,103,622 B2 * 8/2015 Park ..... F41B 5/1426
9,228,791 B2 * 1/2016 Saunders ..... F41B 5/1426
9,360,271 B1 * 6/2016 McPherson ..... F16F 7/108
9,752,845 B1 * 9/2017 Braun ..... F41B 5/105
9,915,494 B2 3/2018 Potts
10,184,750 B2 * 1/2019 McPherson ..... F41B 5/123
10,393,471 B2 * 8/2019 McPherson ..... F41B 5/1426
10,563,949 B2 2/2020 McPherson et al.
10,816,304 B2 10/2020 McPherson et al.
11,029,121 B2 6/2021 McPherson
2002/0020403 A1 * 2/2002 Troubridge ..... F41B 5/1426 124/25
2002/0078939 A1 6/2002 Andrews et al.
2003/0094168 A1 * 5/2003 Sims ..... F41B 5/1426 124/89
2004/0077440 A1 * 4/2004 Kronfeld ..... F41B 5/1426 473/578
2005/0121012 A1 * 6/2005 McPherson ..... F41B 5/0026 124/23.1
2006/0011181 A1 1/2006 Andrews
2006/0180135 A1 * 8/2006 Andrews ..... F41B 5/1426 124/89
2010/0263650 A1 * 10/2010 Dahl, II ..... F41B 5/14 124/88
2012/0006311 A1 * 1/2012 Bednar ..... F41B 5/12 124/25
2014/0041645 A1 * 2/2014 Wasilewski ..... F41B 5/1426 124/89
2017/0030674 A1 * 2/2017 Ell ..... F41B 5/1403
2020/0393212 A1 * 12/2020 Gann ..... F41B 5/1461

* cited by examiner

ARCHERY BOW LIMB CUP WITH DAMPER

CROSS-REFERENCE TO RELATED APPLICATIONS

This application is a continuation and claims the benefit of U.S. patent application Ser. No. 16/374,599, filed Apr. 3, 2019, which claims the benefit of U.S. Patent Application No. 62/652,246, filed Apr. 3, 2018, the entire content of which is hereby incorporated herein by reference.

BACKGROUND OF THE INVENTION

This invention relates generally to archery bows, which are known in the art and are generally used to shoot arrows.

As a bow is drawn, it stores energy that is later released as the arrow is fired. It is desirable for as much energy as possible to be transferred to the arrow, but residual energy that is not transferred to the arrow can remain present in the bow after the shot. Such residual energy can result in shock, noise and vibrations.

There remains a need for novel bow structures that help to reduce and dissipate residual energy present in a bow.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a limb cup comprises a body and a vibration damper. The body comprises a first limb cavity and a damper housing. The damper housing comprises an aperture. The vibration damper comprises a resilient member and a weight. The first limb cavity is arranged to receive an archery bow limb. The resilient member is oriented in the aperture and supported by the damper housing. The weight is supported by the resilient member.

In some embodiments, the body comprises a single piece of material.

In some embodiments, the damper housing integrally formed with the body.

In some embodiments, a separate damper housing is attached to the body.

In some embodiments, a limb cup comprises a body comprising a limb cavity and a post. The limb cavity is arranged to receive an archery bow limb. A vibration damper comprises a resilient member and a weight. The post supports the resilient member and the resilient member supports the weight.

In some embodiments, the post is integral with the body. In some embodiments, the weight surrounds the post.

In some embodiments, an archery bow comprises a riser and a limb cup attached to the riser. The limb cup comprises a limb cavity and a vibration damper. The vibration damper comprises a resilient member and a weight. A limb is supported by the limb cup with a portion of the limb oriented in the limb cavity.

In some embodiments, the limb cup comprises a body comprising the limb cavity and a damper housing.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
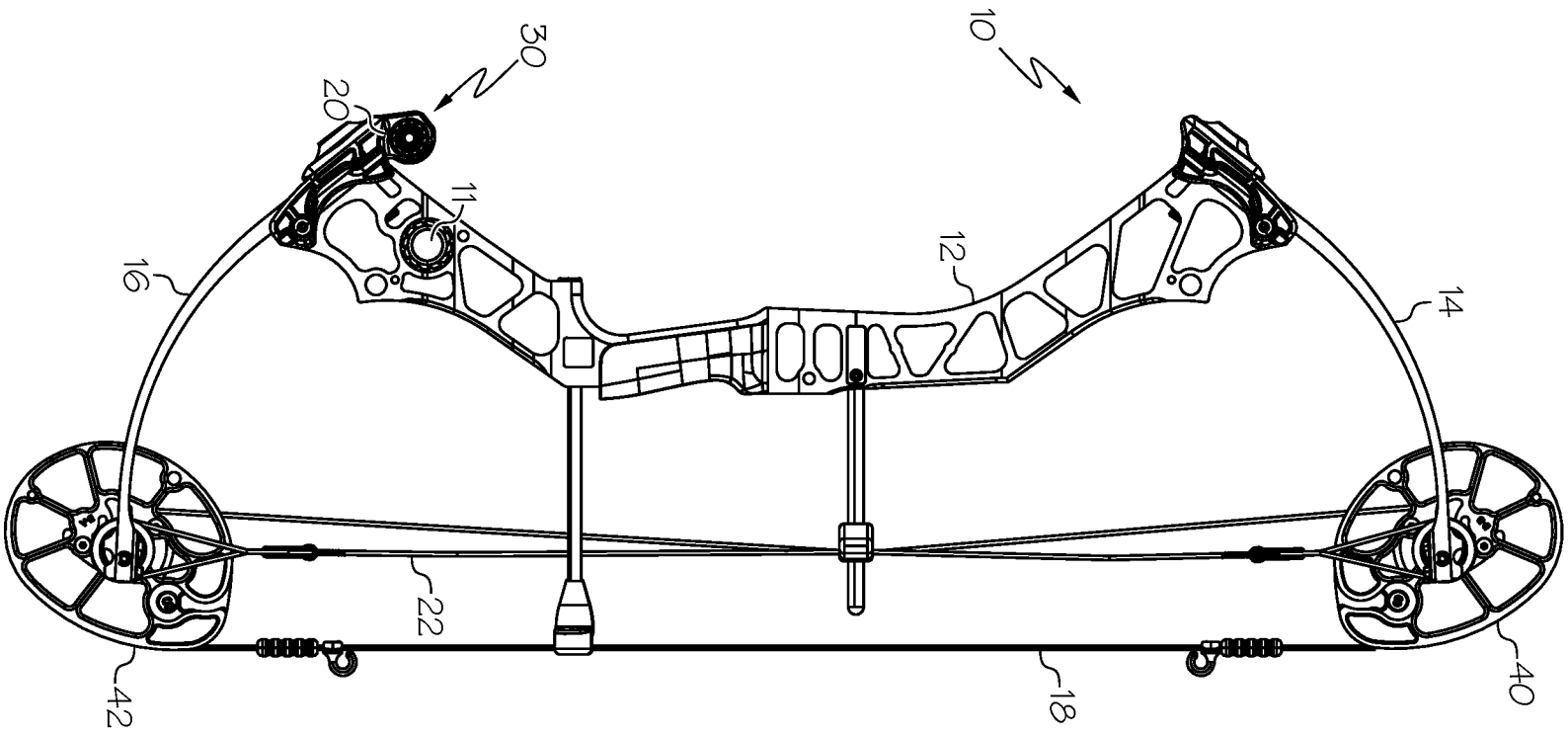
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, an archery bow 10 comprises a limb cup 20 that comprises a vibration damper 30.

In some embodiments, an archery bow 10 comprises a riser 12, a first limb 14, a second limb 16, a first rotatable member 40, a second rotatable member 42, a bowstring 18 and at least one power cable 22. Some examples of archery bows are disclosed in U.S. Pat. No. 8,020,544, the entire disclosure of which is hereby incorporated herein by reference.

In some embodiments, the bow 10 comprises a limb cup 20. In some embodiments, a limb 16 is supported by a limb cup 20, and the limb cup 20 is supported by the riser 12. In some embodiments, a limb cup 20 comprises features as described in U.S. Pat. No. 8,453,635, the entire disclosure of which is hereby incorporated herein by reference.

In some embodiments, the riser 12 comprises a vibration damper 11, for example as described in U.S. Pat. No. 6,257,220, the entire disclosure of which is hereby incorporated herein by reference. In some embodiments, a riser 12 and a riser-mounted vibration damper 11 are configured as shown in US 2018/0306550, the entire disclosure of which is hereby incorporated herein by reference.

Figure 2:
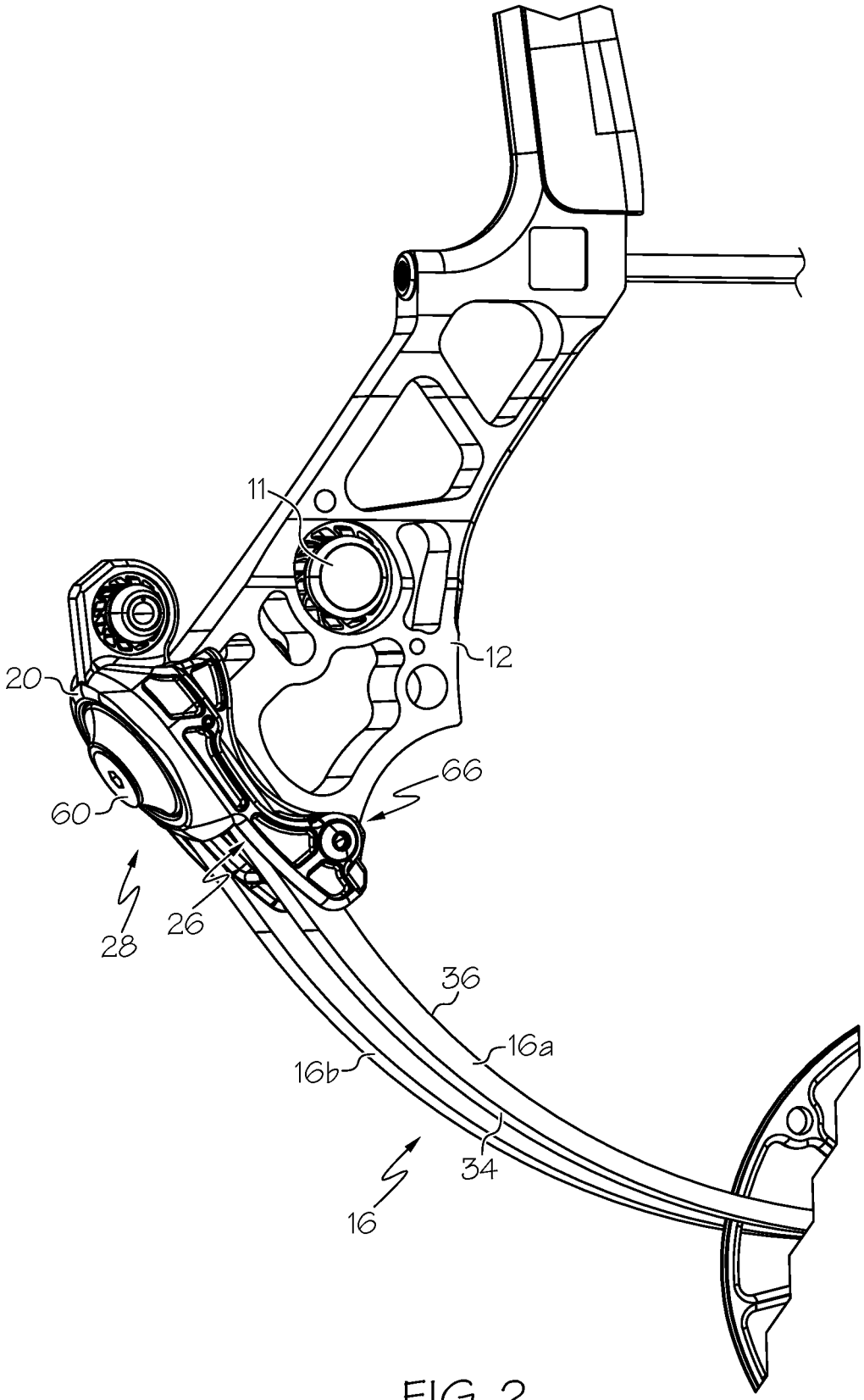
FIGS. 2 and 3 show more detailed views of the archery bow shown in FIG. 1.
Figure 3:
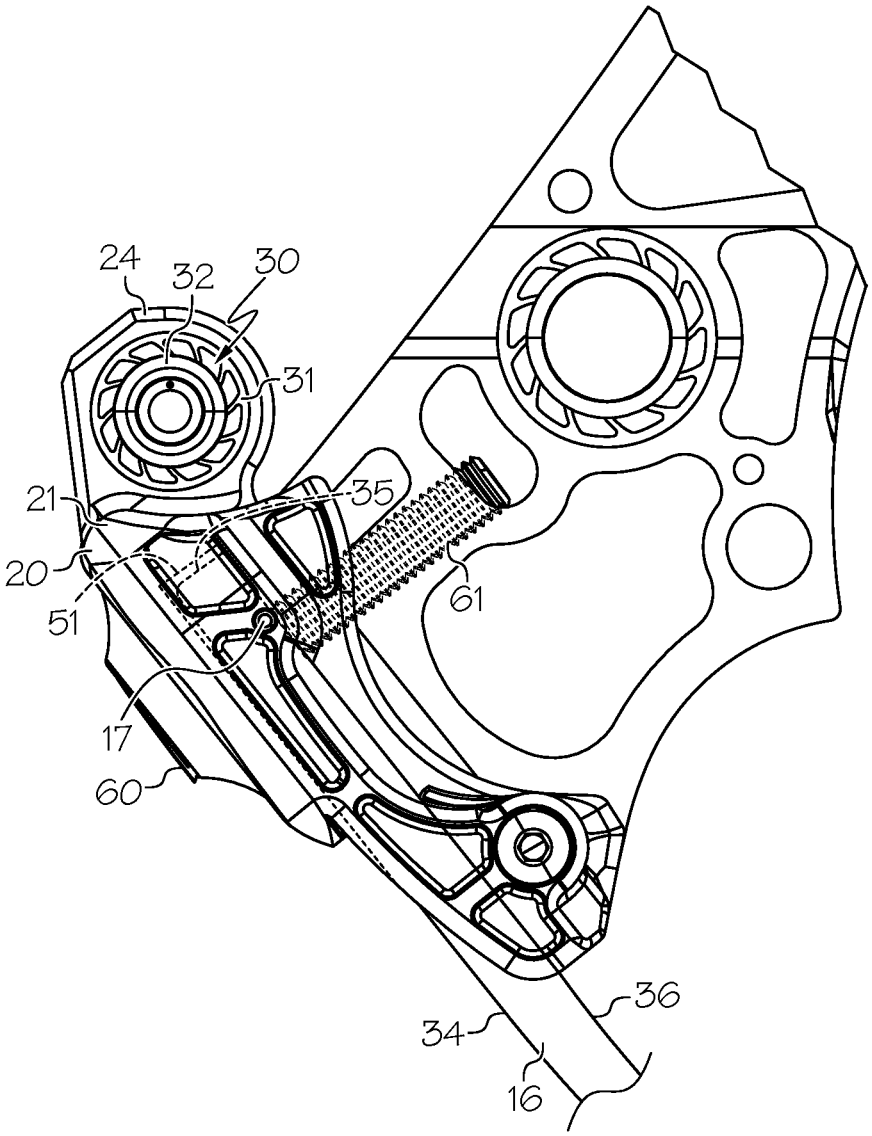
Figure 4:
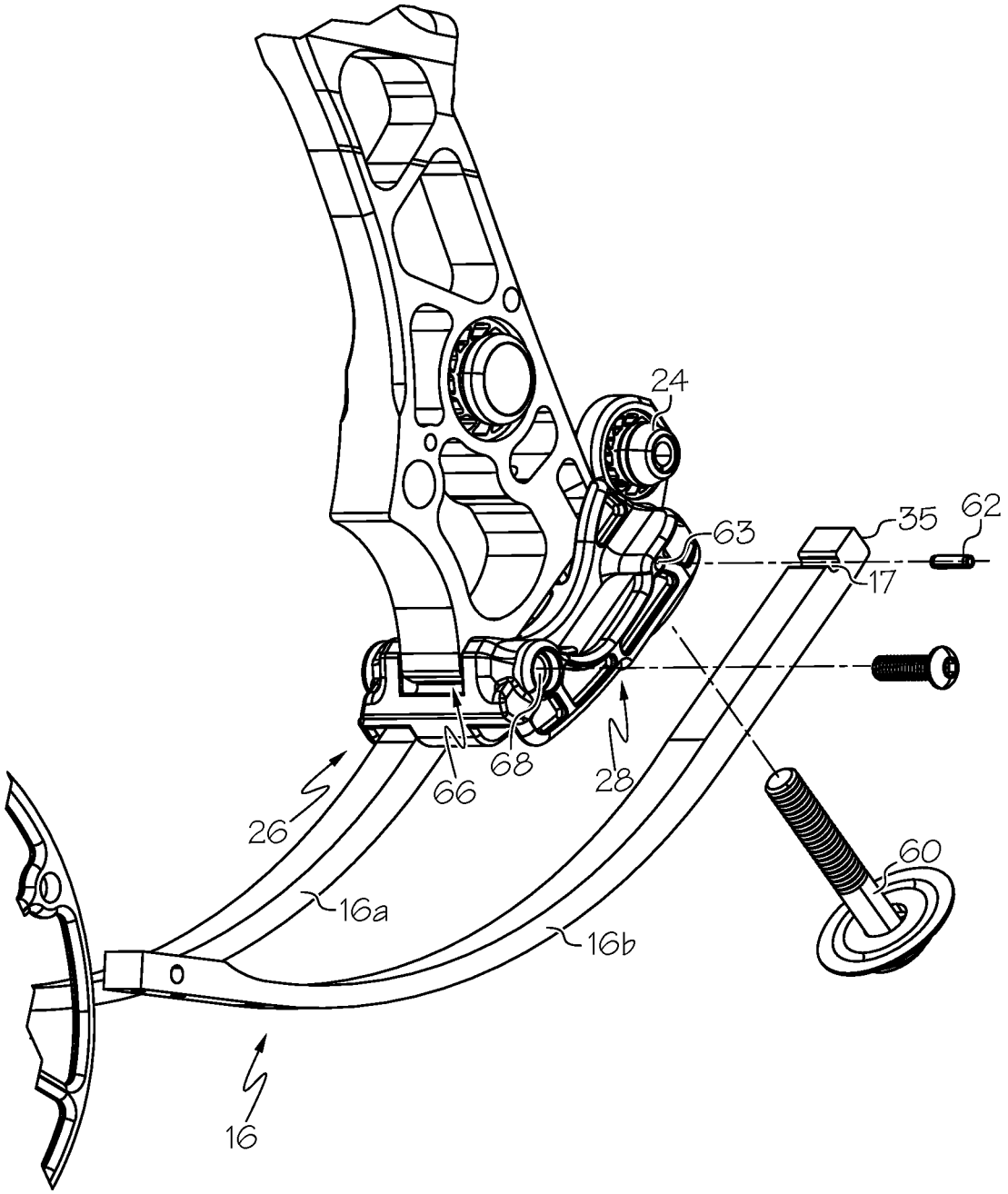
FIG. 4 shows an exploded view of a portion of the bow of FIG. 1.
Figure 5:
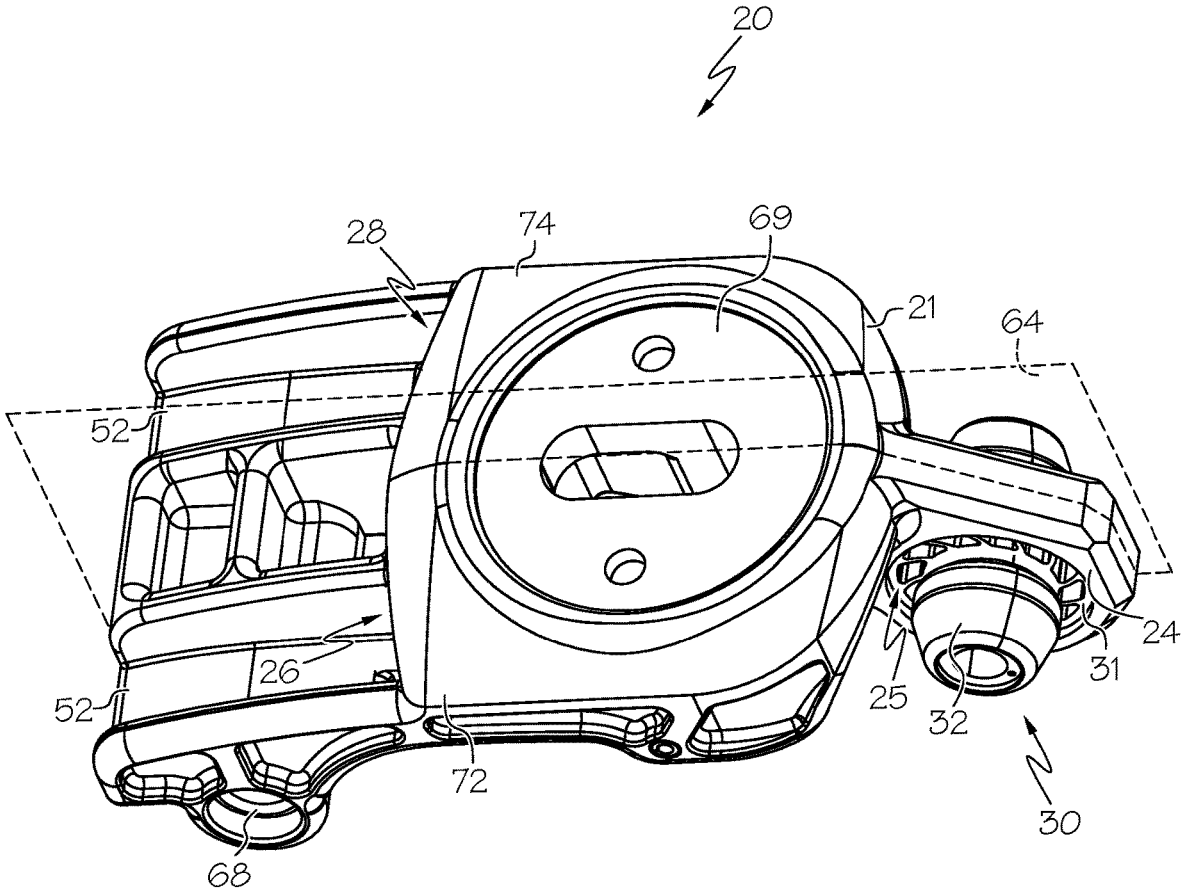
FIGS. 5-7 show views of an embodiment of a limb cup.
Figure 6:
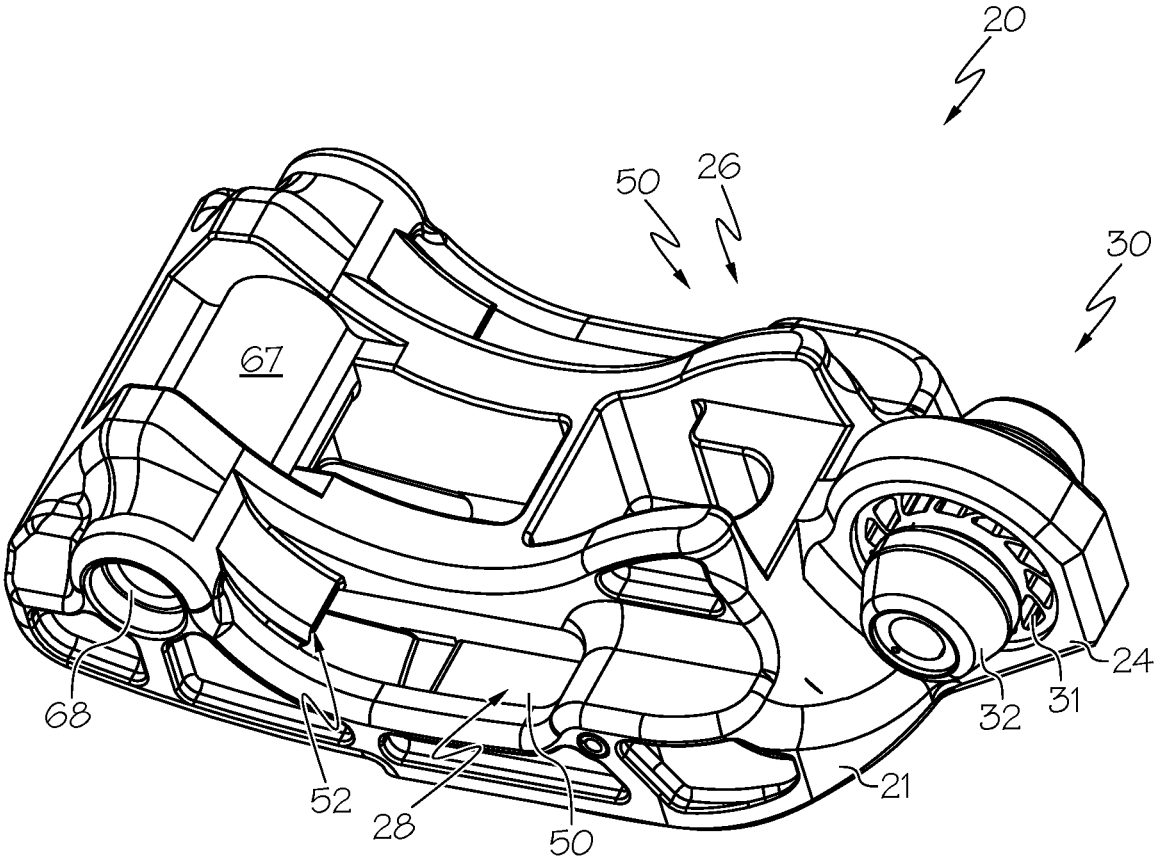
Figure 7:
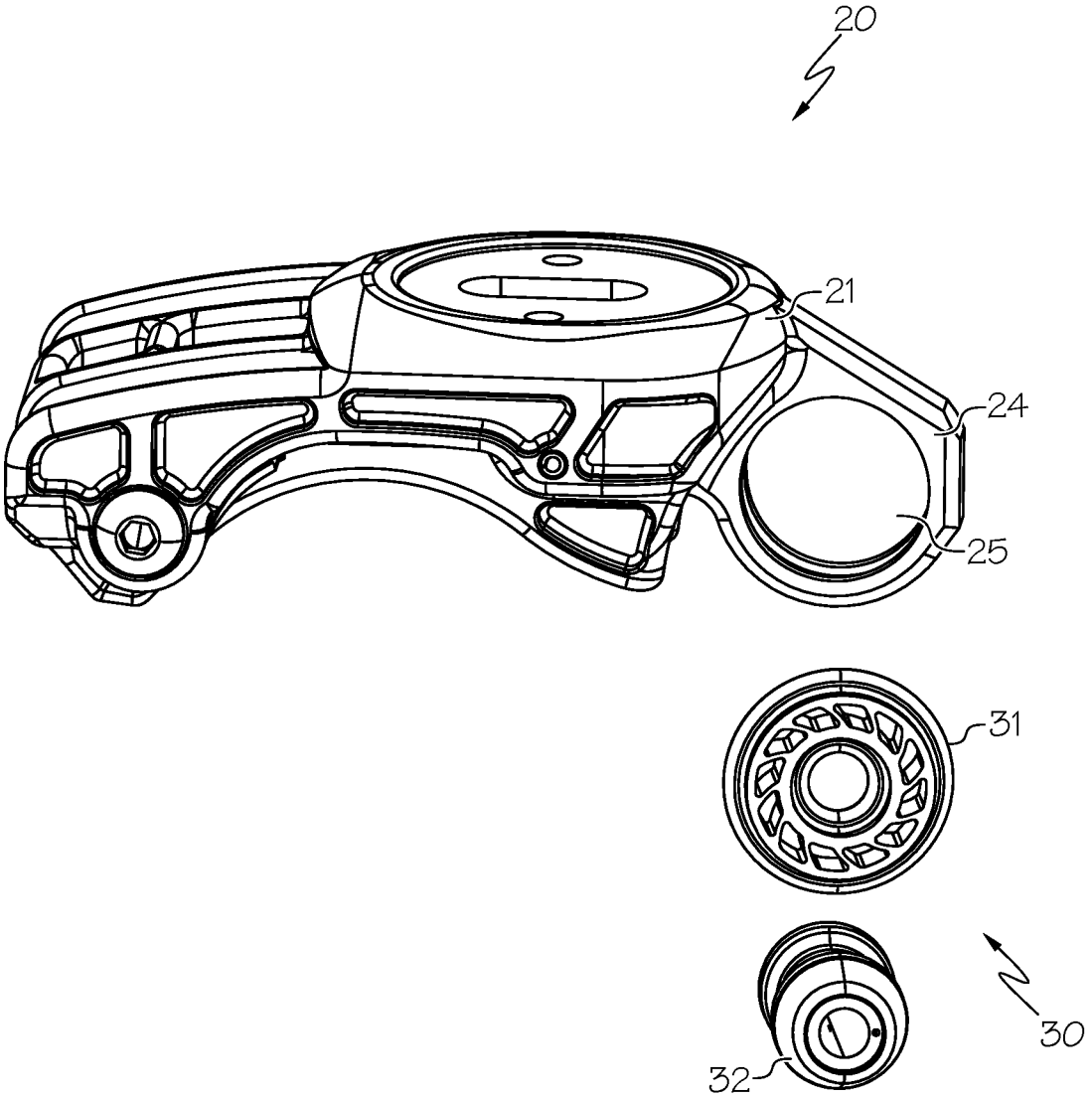

FIG. 2 shows a more detailed view of the bow 10 shown in FIG. 1, and FIG. 3 shows another view where some parts within the limb cup 20 are visible. FIG. 4 shows an exploded view. FIGS. 5-7 show detailed views of an embodiment of a limb cup 20.

In some embodiments, forces are transferred across the limb cup 20 between the riser 12 and limb 16. In some embodiments, the limb cup 20 and/or limb 16 is attached to the riser 12 via a fastener 60 such as a limb bolt. In some embodiments, the fastener 60 transfers tensile forces between the riser 12 and limb 16. In some embodiments, the limb cup 20 and/or limb 16 transfers compressive forces across a bearing zone 66 between the limb 16 and riser 12.

In some embodiments, a limb cup 20 comprises a body 21. In some embodiments, the body 21 is formed from a single piece of material. In some embodiments, the body 21 consists of a single piece of material.

In some embodiments, the body 21 comprises a damper housing 24 arranged to support a vibration damper 30. In some embodiments, the damper housing 24 is integral with the body 21.

In some embodiments, the damper housing 24 defines an aperture 25. In some embodiments, the aperture 25 is arranged to receive a vibration damper 30. In some embodiments, the aperture 25 comprises a circular shape. In some embodiments, a vibration damper 30 comprises a resilient member 31 and a weight 32. In some embodiments, the resilient member 31 suspends the weight 32 with respect to the damper housing 24. In some embodiments, the resilient member 31 supports the weight 32. In some embodiments, the damper housing 24 supports the resilient member 31. In some embodiments, the resilient member 31 is the only portion of the device that contacts the weight 32. In some embodiments, the damper housing 24 is the only portion of the limb cup 20 that contacts the resilient member 31.

In some embodiments, the body 21 defines a limb cavity 26.

In some embodiments, a limb cup 20 comprises a limb cavity 26 arranged to receive a limb 16. In some embodiments, a limb 16 comprises a first end 35, a second end 37, a tension surface 34 and a compression surface 36. In some embodiments, the first end 35 of a limb 16 is oriented in the limb cavity 26 and the second end 37 of the limb 16 is positioned away from the limb cup 20.

In some embodiments, a limb 16 comprises a recess 17. In some embodiments, the recess 17 is aligned with an aperture 63 in the limb cup 20 when the limb 16 is positioned in the limb cavity 26. In some embodiments, a fastener 62 is used to secure the limb 16 to the limb cup 20. In some embodiments, a first portion of a fastener 62 is positioned in the aperture 63 and a second portion of the fastener 62 is positioned in the recess 17. In some embodiments, a fastener 17 comprises a spring pin.

In some embodiments, the limb cavity 26 is at least partially defined by a tension-side bearing surface 50 arranged to contact the tension surface 34 of the limb 16. In some embodiments, the limb cavity 26 is at least partially defined by a compression-side bearing surface 52 arranged to contact the compression surface 36 of the limb 16. In some embodiments, the limb cavity 26 is at least partially defined by an end wall 51. Desirably, the tension-side bearing surface 50 and the compression-side bearing surface 52 are arranged to receive forces from a limb 16 and transfer forces to the limb cup 20.

In some embodiments, the limb cup 20 comprises a compression transfer bearing surface 67. In some embodiments, the compression transfer bearing surface 67 contacts the riser 12. In some embodiments, the limb cup 20 body 21 receives compressive forces from the limb 16 at the compression-side bearing surface 52, and the body 21 transfers the compressive forces to the riser 12 via the compression transfer bearing surface 67. In some embodiments, the compression-side bearing surface 52 and the compression transfer bearing surface 67 are adjacent one another. In some embodiments, the compression-side bearing surface 52 and the compression transfer bearing surface 67 comprise opposing surfaces.

In some embodiments, the limb cup 20 comprises a reinforcing member 68 such as an axle, for example as disclosed in US 2017/0138691, the entire content of which is hereby incorporated herein by reference. In some embodiments, a reinforcing member 68 provides structural reinforcement to the body 21. In some embodiments, the reinforcing member 68 is formed from a material that is different from the body 21. In some embodiments, a first portion of the reinforcing member 68 is arranged to receive compressive forces from the limb 16 and a second portion of the axle is arranged to apply compressive forces to the riser 12.

In some embodiments, the limb cup 20 comprises a tension transfer bearing surface 69. In some embodiments, the tension transfer bearing surface 69 contacts a fastener 60. In some embodiments, the limb cup 20 body 21 receives forces from the limb 16 at the tension-side bearing surface 50, and the body 21 transfers the forces to the fastener 60 via the tension transfer bearing surface 69. In some embodiments, the tension-side bearing surface 50 and the tension transfer bearing surface 69 are adjacent one another. In some embodiments, the tension-side bearing surface 50 and the tension transfer bearing surface 69 comprise opposing surfaces.

In some embodiments, a limb 16 comprises a first limb member **16*a* and a second limb member 16*b*. In some embodiments, the limb cavity 26 comprises a first limb cavity 26, and the body 21 further comprises a second limb cavity 28**.

In some embodiments, a reference plane 64 is aligned upon a central axis or midline of the limb cup 20. In some embodiments, the reference plane 64 bisects the body 21, and the body 21 comprises a first half 72 that is symmetric with a second half 74 across the reference plane 64.

In some embodiments, the first limb cavity 26 is symmetric with the second limb cavity 28 across the reference plane 64.

In some embodiments, the damper housing 24 is symmetric across the reference plane 64.

In some embodiments, the vibration damper 30 is centered upon the reference plane 64. In some embodiments, the resilient member 31 is symmetric across the reference plane 64. In some embodiments, the weight 32 is symmetric across the reference plane 64.

In some embodiments, a limb 16 is oriented in the limb cavity 26 with the first end 35 of the limb 16 positioned near or contacting the end wall 51. In some embodiments, the limb 16 extends out of the limb cavity 26 and the second end 37 of the limb 16 is positioned away from the limb cup 20. In some embodiments, a fastener 60 attaches the limb cup 20 to the riser 12, and the fastener 60 comprises a shaft 61 that extends into the riser 12. In some embodiments, the damper housing 24 is positioned just beyond the limb 16, close to the first end 35 of the limb 16. In some embodiments, the limb cavity 26 extends to a first side of the end wall 51 and the damper housing 24 is positioned on a second side of the end wall 51. In some embodiments, the damper housing 24 and limb cavity 26 are positioned on opposite sides of the end wall 51. In some embodiments, a majority of a length of a limb 16 is positioned to a first side of the fastener 60 and the damper housing 24 is positioned to a second side of the fastener 60. In some embodiments, a majority of a length of a limb 16 is positioned to a first side of the fastener shaft 61 and the damper housing 24 is positioned to a second side of the fastener shaft 61. In some embodiments, the first end 35 of the limb 16 is located between the damper housing 24 and the fastener shaft 61.

Figure 8:
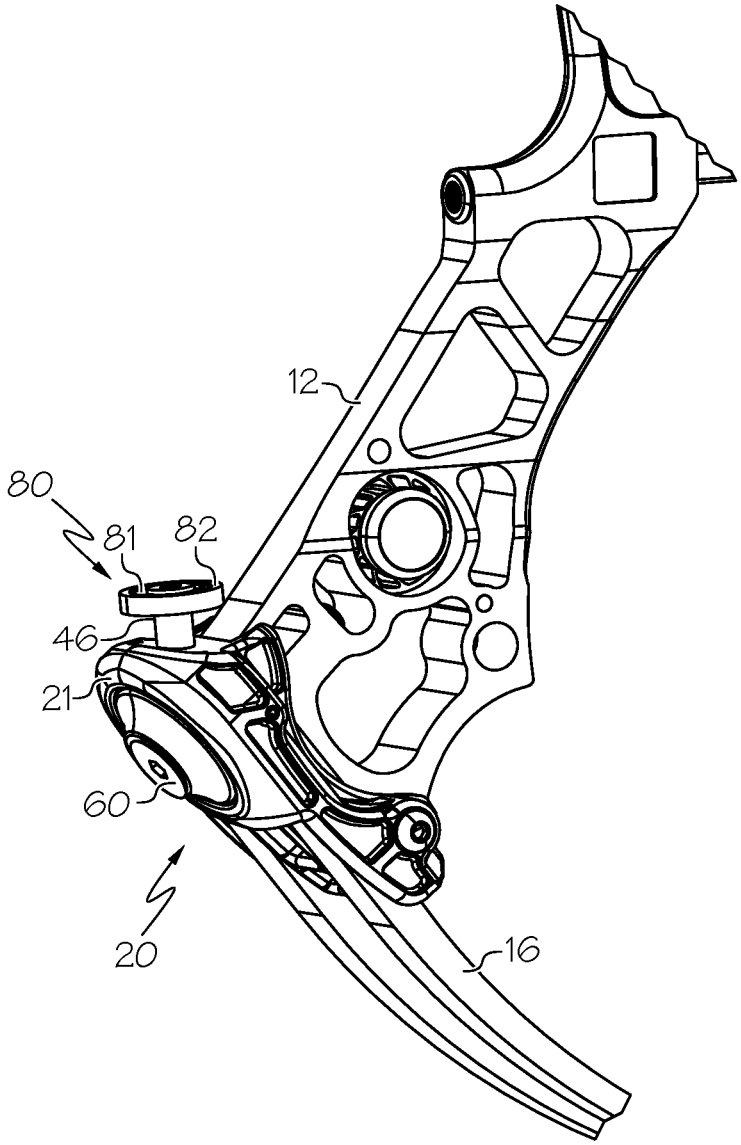
FIGS. 8 and 9 show an embodiment of a bow with another embodiment of a limb cup.
Figure 9:
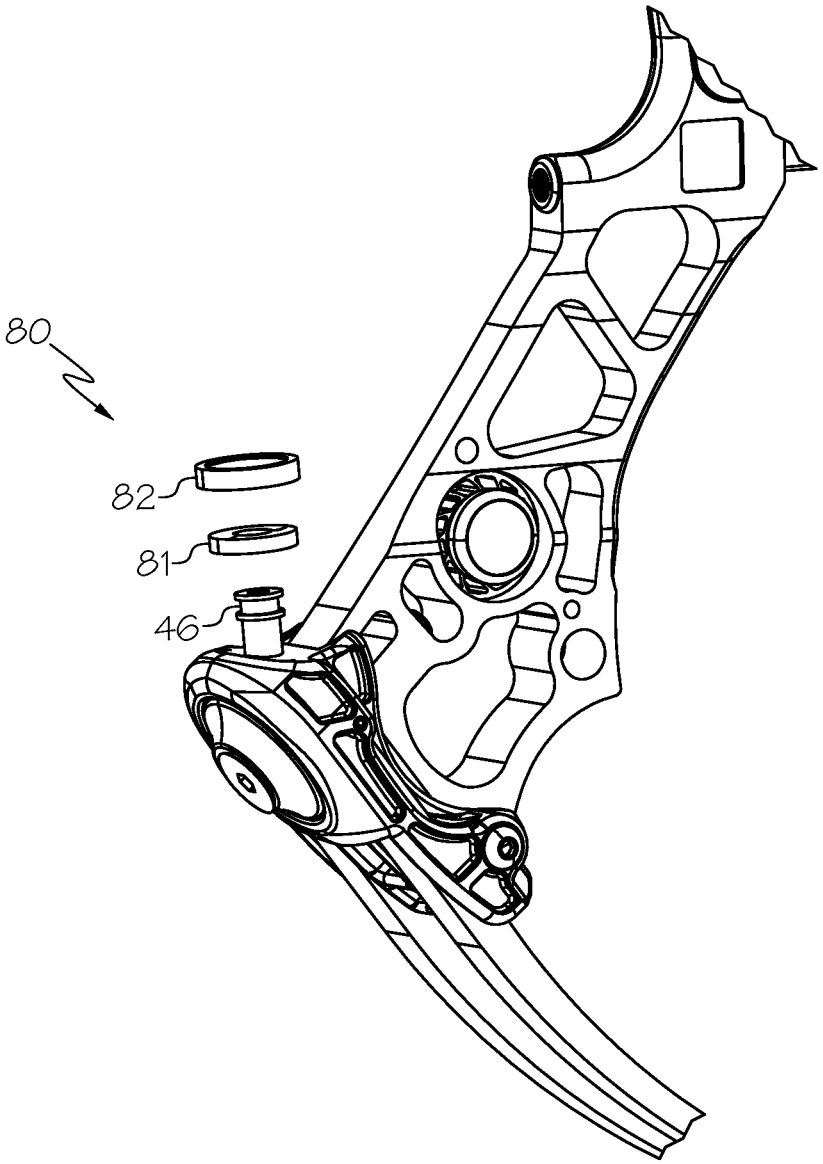

FIGS. 8 and 9 show another embodiment of a limb cup 20. In some embodiments, a limb cup 20 comprises a vibration damper 80 comprising a resilient member 81 and a weight 82, wherein the weight 82 surrounds the resilient member 81. In some embodiments, the limb cup 20 comprises a post 46, and the vibration damper 80 is attached to the post 46. In some embodiments, the post 46 is integrally formed with the body 21 of the limb cup 20. In some embodiments, the post 46 supports the resilient member 81 and the resilient member 81 supports the weight 82. In some embodiments, the weight 82 surrounds the post 46.

Figure 10:
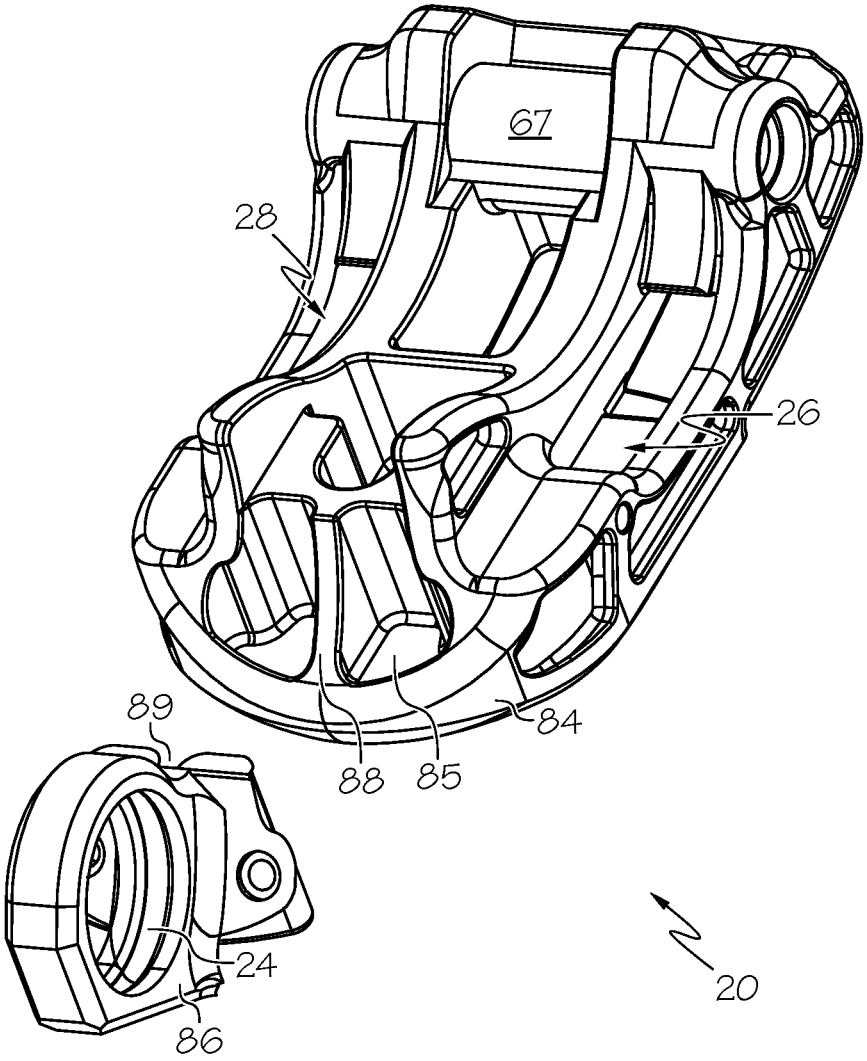
FIGS. 10 and 11 show another embodiment of a limb cup.
Figure 11:
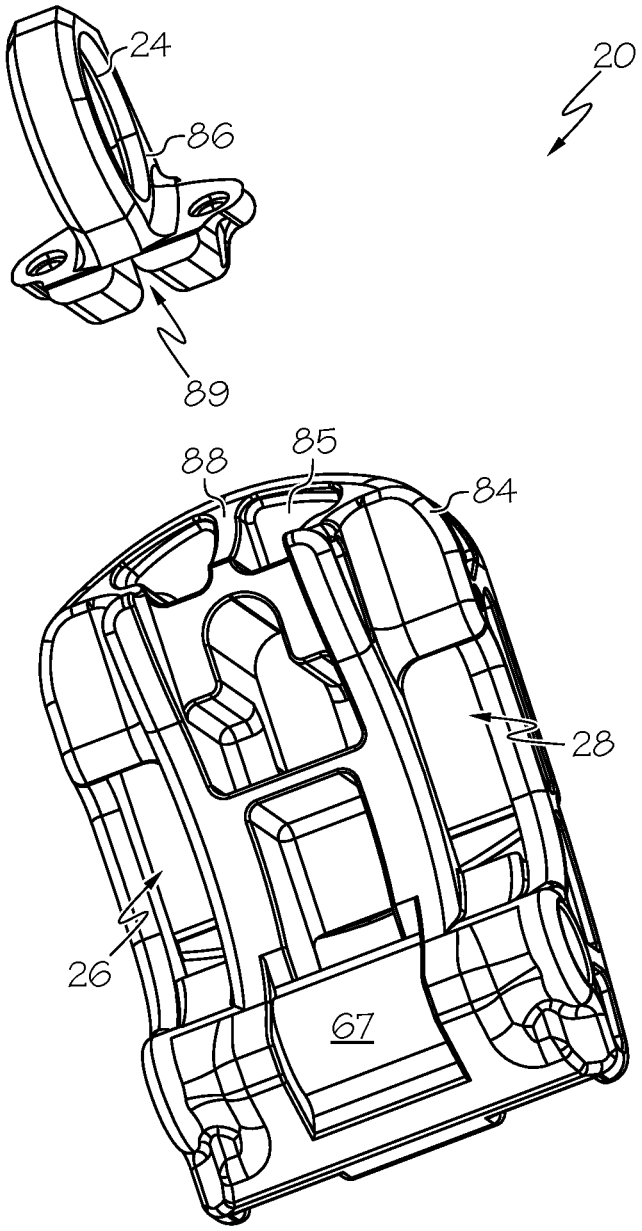

FIGS. 10 and 11 show another embodiment of a limb cup 20. In some embodiments, a limb cup 20 comprises a first portion 84 and a second portion 86. In some embodiments, the first portion 84 comprises a first limb cavity 26. In some embodiments, the first portion 84 further comprises a second limb cavity 28. In some embodiments, the first portion 84 is formed from a single piece of material. In some embodiments, the first portion 84 generally comprises all portions of the body 21 as described herein except for the damper housing 24. In some embodiments, the second portion 86 of the limb cup 20 comprises a damper housing 24. Desirably, the second portion 86 is attachable to the first portion 84 to form a limb cup 20 comprising a damper housing 24.

In some embodiments, the second portion 86 is attached to the first portion 84 by resiliency of the parts, such as under resilient deformation of either or both components, and/or an interference fit between components. In some embodiments, the first portion 84 and second portion 86 are configured for a snap-fit connection. In some embodiments, the first portion 84 and second portion 86 are attached by a fastener such as a threaded fastener. In some embodiments, the first portion 84 and second portion 86 are attached using an adhesive.

In some embodiments, one of the first portion 84 or the second portion 86 comprises a cavity 85, and the other portion 84, 86 comprises a complimentary shape that is configured to occupy the cavity 85. In some embodiments, one of the first portion 84 or the second portion 86 comprises a protrusion 88, and the other portion 84, 86 comprises a complimentary shaped recess 89.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A limb cup comprising:

a body comprising a first limb cavity, a second limb cavity and a damper housing, the damper housing comprising an aperture, the body symmetric across a reference plane, the aperture oriented in the reference plane; and a vibration damper comprising a resilient member and a weight;

wherein the first limb cavity is arranged to receive a first archery bow limb portion, the second limb cavity is arranged to receive a second archery bow limb portion, the resilient member is oriented in the aperture and supported by the damper housing, and the weight is supported by the resilient member.

2. The limb cup of claim 1, the body comprising a single piece of material.

3. The limb cup of claim 1, the damper housing integrally formed with the body.

4. The limb cup of claim 1, the damper housing attached to the body by a fastener.

5. The limb cup of claim 1, the damper housing attached to the body by resilient deformation or interference fit between the damper housing and the body.

6. The limb cup of claim 1, the first limb cavity at least partially defined by a tension bearing surface and a compression bearing surface.

7. The limb cup of claim 1, the weight comprising a central axis oriented orthogonal to the reference plane.

8. The limb cup of claim 1, wherein the first limb cavity and the second limb cavity are symmetric across the reference plane.

9. The limb cup of claim 8, wherein a first half of the body is symmetric with a second half of the body across the plane.

10. The limb cup of claim 8, wherein the vibration damper is symmetric across the plane.

11. An archery bow comprising:

a riser;

a limb cup attached to the riser, the limb cup comprising a first limb cavity, a second limb cavity and a vibration damper, the vibration damper comprising a resilient member and a weight, the limb cup symmetric across a reference plane, the weight comprising a central axis oriented orthogonal to the reference plane; and a limb assembly supported by the limb cup, a first portion of the limb assembly oriented in the first limb cavity and a second portion of the limb assembly oriented in the second limb cavity.

12. The archery bow of claim 11, the limb cup comprising a body comprising the limb cavity and a damper housing, the damper housing comprising an aperture.

13. The archery bow of claim 12, the resilient member oriented in the aperture and supported by the damper housing, the weight supported by the resilient member.

14. The archery bow of claim 11, the limb cup attached to the riser by a fastener, the vibration damper positioned on a first side of the fastener, the limb extending away from the vibration damper to a second side of the fastener.

15. The archery bow of claim 12, the aperture oriented in the reference plane.

16. The archery bow of claim 11, the resilient member comprising a central axis oriented orthogonal to the reference plane.

* * * * *